United States Patent [19]

Muller et al.

[11] 4,236,993

[45] Dec. 2, 1980

[54] ELECTRODE FOR WATER ELECTROLYSIS

[75] Inventors: Rene Muller, Fislisbach; Samuel Stucki, Baden, both of Switzerland

[73] Assignee: BBC Brown, Boveri & Company, Limited, Baden, Switzerland

[21] Appl. No.: 98,688

[22] Filed: Nov. 29, 1979

[30] Foreign Application Priority Data

Jan. 17, 1979 [CH] Switzerland ..... 434/79
Jan. 17, 1979 [CH] Switzerland ..... 435/79

[51] Int. Cl.[3] ..... C25B 11/06; C25B 11/12; C25B 11/14; C25B 11/10

[52] U.S. Cl. ..... 204/294

[58] Field of Search ..... 204/290 R, 291, 294

[56] References Cited

FOREIGN PATENT DOCUMENTS 749507 10/1970 Belgium ..... 204/290 R

*Primary Examiner*—Howard S. Williams
*Attorney, Agent, or Firm*—Oblon, Fisher, Spivak, McClelland & Maier

[57] ABSTRACT

An electrode for water electrolysis which comprises a solid solution of graphite and polytetrafluorethylene impregnated with a catalyst mixture of platinum metal oxides, the solid solution being pressed and sintered on a reinforcing net of metal cloth, as well as a process for preparing the electrode. The electrodes are useful in large scale water electrolysis for the production of hydrogen.

12 Claims, 1 Drawing Figure

ELECTRODE FOR WATER ELECTROLYSIS

BACKGROUND OF THE INVENTION

1. Field of the Invention

The present invention relates to an electrode for water electrolysis and for a process for producing the same.

2. Description of the Prior Art

Electrodes, as well as processes for their manufacture, are particularly known from the technology developed for fuel cells, as for example from Berger, Carl, "Handbook of Fuel Cell Technology", pages 401–406, (Prentiss-Hall 1968) and Liebhafsky, H. A., and Cairns, E. J., "Fuel Cells and Fuel Batteries", pages 289–294 (John Wiley & Sons, 1968). The demand for an exactly defined reaction zone however requires a multiple-layer design and special treatment processes for such fuel cell electrodes.

The aforementioned electrodes are too complex in the design and too complicated and expensive in their production methods for water electrolysis. This fact applies particularly to production methods for large industrial plants involved in the economic production of hydrogen.

Electrodes for water electrolysis cells have been proposed, as for example in U.S. Pat. No. 4,039,409. These are mostly doped with catalysts, to accelerate the electro-chemical reactions.

The described electrodes have drawbacks with respect to their mechanical and chemical characteristics and the same is true with respect to those with applied catalysts.

A need therefore continues to exist for an electrode useful in water electrolysis which is not too complex in design, which is useful for the large industrial production of hydrogen and which has superior mechanical and chemical characteristics.

SUMMARY OF THE INVENTION

It is therefore an object of the invention to provide an electrode for water electrolysis.

Another object of the invention is to provide an electrode for water electrolysis which has good mechanical and chemical characteristics.

A further object of the invention is to provide an electrode for water electrolysis useful for the large scale production of hydrogen.

Still another object of the invention is to provide a process for preparing an electrode.

These and other objects of the invention which will more readily become apparent hereinafter have been attained by providing:

an electrode for water electrolysis which comprises a solid solution of graphite and polytetrafluorethylene impregnated with a catalyst mixture of platinum metal oxides, the solid solution being pressed and sintered on a reinforcing net of metal cloth.

Another object of the invention has been attained by providing a process for preparing the aforementioned electrode which comprises: mixing graphite and polytetrafluorethylene powders, pressing the mixture on a net of fine metal cloth, sintering the pressed mixture under an argon atmosphere at 340°–400° C., i.ersing said sintered mixture into an alcoholic solution of platinum metal chlorides, drying the resulting mixture, and oxidizing the mixture in air at 340°– 400° C.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
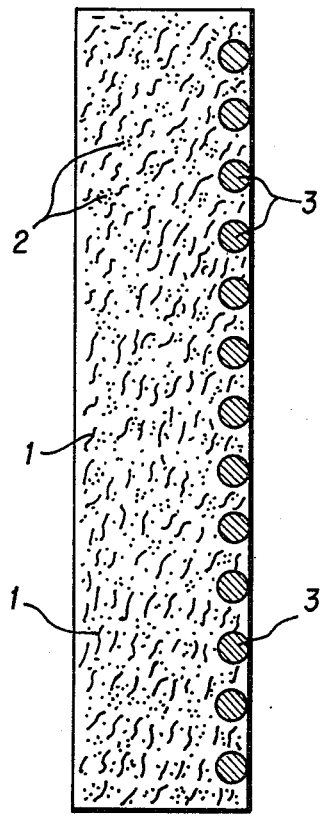
FIG. 1 is a cross-section of an electrode of the present invention and wherein a porous mass comprising graphite 1 and polytetrafluorethylene 2 is pressed on a net of metal cloth 3, which for the anode side is preferably Ta and Ti, and for the cathode side is preferably Ni, brass, bronze or any other copper alloy.

This invention is based on an electrode for water electrolysis which has a good conductivity and good permeability for water and gas, has a long life as well as the property of accelerating the water electrolysis reaction in an optimum manner through catalytic effects.

It has proven to be advantageous to use a porous, permeable solid solution on a graphite basis as the material for the electrode and impregnating the same with a mixture of platinum-metal oxides as the catalyst. For these purposes, ruthenium oxide and iridium oxide are particularly preferred, favorably either alone, in mixtures with each other or with an additional platinum metal oxide.

The metal cloth serving as reinforcement, can be made of wire of 0.05 to 0.2 mm diameter. The material is chosen depending on whether the electrode will serve as the anode or the cathode. When the electrode serves as the anode, the material of the net of metal cloth is preferably Ta or Ti, and when the electrode serves as the cathode, the metal cloth is preferably nickel, brass, bronze or any other copper alloy.

The powder mixture of graphite and polytetrafluorethylene can be varied within the limits of 60–95% by weight graphite and 5–40% by weight polytetrafluorethylene. By changing the ratio of the mixture, mechanical stability and resistance as well as porosity and electrical conductivity of the electrode can be influenced within certain limits, and adapted to the respective conditions in optimum manner.

The ratio of the mixture of the catalyst can be 10–70% by weight $RuO_2$ and 90–30% by weight $IrO_2$. After repeated experimentation it has been found that the catalyst mixture of $RuO_2/IrO_2$ tends in an oxidizing atmosphere to a chemical-thermodynamical equilibrium at a very definite mixture ratio. A mixture of 20% by weight $RuO_2$ and 80% by weight $IrO_2$ has been found to be the most stable. The electrode is thus prepared in such an advantageous manner that the end product will contain precisely such as mixture ratio.

During the process of preparation of the electrode, the sintering as well as oxidizing can be effected at 340°–400° C.

This process can be applied in a particularly advantageous manner for the production of electrodes for high efficiency water electrolysis units in the production of hydrogen. Owing to its simplicity and economy, it is particularly suitable for the production in series of large-surface electrodes for large industrial plants.

The electrodes manufactured in this manner are characterized by a high chemical resistance and a favorable electrolytic voltage.

Having generally described this invention, a further understanding can be obtained by reference to certain specific examples which are provided herein for purposes of illustration only and are not intended to be limiting unless otherwise specified.

Example of a Design for an Electrode 12.75 g (corresponding to 85% by weight) of graphite powder, grain sizes up to 0.1 mm, were ground in toluene in a ball mill for 6 hours with 2.25 g (corresponding to 15% by weight) of polytetrafluorethylene powder (for example "Teflon" 702N of Du Pontde Nemours). The suspension of graphite and polytetrafluorethylene particles in toluene prepared by this manner was dried in a drying oven for 3 hours to form a solid mass. Subsequently, the dried mass was broken up, ground and passed through a sieve with round holes of 0.25 mm diameter.

A piece of cloth made of tantalum wire (wire diameter is 0.09 mm; 1024 meshes per $cm^2$) was placed into a cylindrical flat matrix and covered with the above-mentioned powder mixture to a maximum height of approximately 2 mm. Attention is to be paid that the powder is uniformly distributed. Subsequently, the powder was compressed at room temperature for 50 seconds by means of a press under a pressure of 140 bar whereby a compact disc, rigidly connected with a metal cloth was obtained.

Finally, the pressed disc was subjected to a sintering process under argon atmosphere in accordance with the following program:

heating: 20°14 375°°C. at 2° C./minute
holding: 375° C. for ½ hour
cooling: 375°–20° C. at 2° C./minute The disc produced in this manner was now inmersed in an alcoholic solution for 10 seconds, a solution which contained 12 relative % by weight of ruthenium chloride ($RuCl_3$) and 88 relative % by weight iridium chloride ($IrCl_3$). After letting it drip for one minute, the disc was oxidized in air for ten minutes at a temperature of 375° C. This process of inmersion and oxidizing was repeated a total of five times. At the end, the disc was once more oxidized in air for four hours at a temperature of 375° C. The electrode manufactured in this manner is characterized by a high chemical resistance and favorable electrolytic voltage.

Having now fully described this invention, it will be apparent to one of ordinary skill in the art that many changes and modifications can be made thereto without departing from the spirit or scope of the invention set forth herein.

What is claimed as new and desired to be secured by Letters Patent of the United States is:

1. An electrode for water electrolysis which comprises:

a solid solution of graphite and polytetrafluorethylene impregnated with a catalyst mixture of platinum metal oxides, said solid solution being pressed and sintered on a reinforcing net of metal cloth.

2. The electrode of claim 1 wherein said catalyst mixture comprises 10–70% by weight of $RuO_2$ and 90–30% by weight of $IrO_2$.

3. The electrode of claim 2 wherein said mixture comprises 20% by weight of $RuO_2$ and 80% by weight of $IrO_2$.

4. The electrode of any of claims 1 or 3 wherein said metal cloth is made of wire having a diameter of 0.05–0.2 mm.

5. The electrode of any of claims 1 or 3 wherein said graphite is present in an amount of 60–95% by weight and said polytetrafluorethylene is present in an amount of 5–40% by weight.

6. The electrode of any of claims 1 or 3 wherein the metal of said net of metal cloth is tantalum.

7. The electrode of any of claims 1 or 3 wherein the metal of said net of metal cloth is titanium.

8. A process for preparing the electrode of claim 1 which comprises mixing graphite and polytetrafluorethylene powders;
pressing said mixture on a net of metal cloth;
sintering said pressed mixture under an argon atmosphere at 340°–400° C.;
inmersing said sintered mixture into an alcoholic solution of platinum metal chlorides;
drying the resulting mixtures; and
oxidizing said mixture in air at 340°–400° C.

9. The process of claim 8 wherein said mixture of graphite and polytetrafluorethylene powders is such that it contains 60–95% graphite and 5–40% polytetrafluorethylene.

10. The process of claim 8 wherein said wire has a diameter of 0.05–0.2 mm.

11. The process of claim 8 wherein said platinum metal chlorides are selected from the group consisting of ruthenium chloride, iridium chloride and mixtures thereof.

12. The process of claim 11 wherein said platinum metal chlorides comprise a mixture of 20% by weight ruthenium chloride and 80% by weight iridium chloride.

* * * * *